US005552000A

United States Patent [19]

Shepherd, Jr.

[11] Patent Number: 5,552,000

[45] Date of Patent: Sep. 3, 1996

[54] SHAPED EXPLOSIVE BY RECRYSTALLIZATION FROM A NON-AQUEOUS SELF-EXPLOSIVE EMULSON

[75] Inventor: Walter B. Shepherd, Jr., Akron, Ohio

[73] Assignee: Mega Research Corporation, Uniontown, Ohio

[21] Appl. No.: 103,390

[22] Filed: Oct. 1, 1987

[51] Int. Cl.[6] ..... C06B 45/00

[52] U.S. Cl. ..... 149/2; 149/92; 149/93; 149/94; 149/96; 149/105; 149/108; 149/109.6

[58] Field of Search ..... 149/2, 88, 92, 149/93, 94, 96, 105, 108, 109.6

[56] References Cited

U.S. PATENT DOCUMENTS 4,600,450 7/1986 Jessop et al. ..... 149/19.3
4,600,451 7/1986 Jessop et al. ..... 149/19.3
4,600,452 7/1986 Jessop et al. ..... 149/19.3
4,632,714 12/1986 Abegg et al. ..... 149/2
4,722,757 2/1988 Cooper et al. ..... 149/2
5,545,829 10/1985 Starkenberg ..... 149/109.6

*Primary Examiner*—Donald P. Walsh
*Assistant Examiner*—Anthony R. Chi

[57] ABSTRACT

An explosive composition is derived from a non-aqueous emulsion of a solution of a self-explosive dispersed as the discontinuous phase (D-phase) throughout a continuous phase (C-phase) which is substantially immiscible with the D-phase. The emulsion is prepared by dropping the solution of self-explosive into a dispersion of surfactant or emulsifier in fuel, at a temperature high enough to prevent precipitation of the self-explosive from solution. Upon cooling and aging, the emulsion becomes a pourable or pumpable mass which gradually is destabilized. Upon destabilization and recrystallization in a cavity, a mass of crystals of self-explosive becomes shaped to the cavity.

12 Claims, No Drawings

SHAPED EXPLOSIVE BY RECRYSTALLIZATION FROM A NON-AQUEOUS SELF-EXPLOSIVE EMULSON

BACKGROUND OF THE INVENTION

This invention relates to a non-aqueous shaped explosive composition having a relatively high density and energy, formed when a hot solution of a self-explosive is emulsified with a surfactant-fuel mixture and the emulsion destabilizes upon cooling and aging. By "self-explosive" I refer to an organic material which can be detonated by itself, for example, with a conventional blasting cap. The self-explosive I use is a compound which contains at least one nitro- or nitramine group.

Prior art non-aqueous systems are referred to as melt-in-oil or melt-in-fuel emulsions such as disclosed in U.S. Pat. No. 4,248,644 in which the fuel or continuous phase contains a surfactant, and the molten oxidizer is dispersed throughout the fuel or continuous phase ("C-phase") by adequate agitation of the mixture which is then allowed to cool. The molten oxidizer is not a self-explosive, that is, it is a non-self-explosive (hereafter "oxidizer"). Upon cooling, the result is that the oxidizer forms an internal or discontinuous phase ("D-phase") of discrete droplets dispersed throughout the continuous (fuel) phase. This "stability" permits the droplets to supercool and remain more or less fluid or grease-like in texture at a temperature below that at which the emulsion was formed.

In the prior art, with very few exceptions, explosive compositions focus the criticality of a stable emulsion which prevents the self-explosive from recrystallizing. It was essential that the emulsion be stable and that no recrystallization of the non-self-explosive (oxidizer) occurred. If recrystallization occurred, the composition would fail to function as an explosive. In my invention, it is essential that there be recrystallization of the self-explosive after destabilization of the emulsion, or the composition would fail to function as a self-explosive.

For example, U.S. Pat. No. 4,566,919 discloses forming a melt or solution of ammonium nitrate in water, at a temperature above the salt crystallization temperature. The melt, or first solution, is then added to a solution of the emulsifier and an immiscible organic liquid fuel, while stirring, to produce a water-in-oil emulsion. The oxidizer is thus dispersed in the fuel phase, initially as droplets of solution at elevated temperature, and as the composition cools, the precipitation of the salts within the droplets is physically inhibited resulting in a stable emulsion with enhanced intimacy between oxidizer and fuel. In contrast, because the liquids are immiscible organic liquids, no water-in-oil emulsion is formed in my composition; the emulsifier is inert; the solvent in the D-phase and the liquid fuel in the C-phase are each essentially anhydrous, so that the emulsion formed is non-aqueous; and, the self-explosive is dissolved in the solvent phase.

More particularly, the emulsion from which the explosive of my invention is derived, is formulated at an elevated temperature, above that at which the self-explosive will crystallize from its solution (referred to herein as a "nitrosolution"). The emulsion consists essentially of a discontinuous nitrosolution phase (D-phase, for brevity) which is dipersed in a continuous phase of surfactant and fuel (C-phase, for brevity). The solution of self-explosive in organic solvent for the self-explosive is referred to herein as a "nitrosolution" because it is a single phase. The organic solvent for the nitro-containing or nitramine-containing self-explosive is referred to as a "nitrosolvent".

The surfactant-in-fuel C-phase consists essentially of at least two phases. The C-phase is a dispersion of surfactant and fuel. After forming the dispersion which is to provide the C-phase, the nitrosolution phase is added with vigorous mixing so as to homogeneously distribute the nitrosolution as the D-phase in the emulsion so formed. The emulsion is formed at a temperature above the recrystallization temperature. By "recrystallization temperature" I refer to the temperature at which crystals of self-explosive commence to form upon cooling a saturated solution of the self-explosive in essentially pure solvent.

The surfactant may function as the emulsifier, and vice versa. In those instances where the surfactant does not function as an emulsifier, an emulsifier is also added. It is essential that the surfactant and/or emulsifier be unreactive with the nitrosolvent, and therefore each is referred to as being substantially inert. Properly formulated, the composition is a thick, creamy or waxlike, pourable or pumpable emulsion which is poured while hot into a cavity and allowed to crystallize into a hard mass upon cooling to ambient temperature.

Heretofore, shapeable self-explosives (explosives) formed from self-explosives such as TNT, pentolite, composition B and the like, were prepared by a kettle procedure in which the material was melted and continuously mixed to ensure homogeneity, and the melt was then cast. But the cast melt shrunk upon cooling, suffered from gradient separation in those instance in which the cast melt was a blend (such as in composition B), and the skrinkage and separation was such that the characteristics of the explosive were generally less predictable than desired. Moreover, because of the sensitivity of TNT and other molten self-explosives, the process was not particularly safe at the elevated temperatures required for preparing the castable melt. The explosive of this invention uses a solution of the self-explosive which is substantially insensitive, making it safer to handle than prior art compositions. The pourable mixture (from which the explosive is derived) can be shaped in a molding cavity without significant shrinkage or gradient separation.

SUMMARY OF THE INVENTION

It has been discovered that a non-aqueous dispersion of surfactant-in-fuel provides the continuous phase (C-phase) for a nitrosolution discontinuous phase (D-phase) of an organic self-explosive selected from the group consisting of poly(nitroaromatic) solids and nitramine solids, such that the C-phase remains the C-phase in an emulsion of nitrosolution/surfactant-in-fuel, even when the C-phase is present only as a thin film surrounding individual D-phase microdroplets of nitrosolution. The peculiar morphology of the composition is realized only when the nitrosolution is non-reactive with and immiscible in the fuel. When the emulsion is cooled sufficiently below the recrystallization temperature, typically to ambient temperature, and aged, the self-explosive crystallizes to produce a shaped mass of discrete self-explosive crystals conforming to the arbitrary shape and size of a cavity in which the emulsion is held.

It is therefore a general object of this invention to provide an explosive composition which comprises a non-aqueous emulsion of a nitrosolution of organic self-explosive in a surfactant-in-fuel dispersion, which emulsion is formed at an elevated temperature which is above the recrystallization temperature of the self-explosive. The emulsion then is supercooled allowing it to be manipulated in a fluid or paste-like state and shaped. The emulsion having limited stability, upon further cooling and aging, inverts, so that the self-explosive subsequently forms a mass of discrete crystals. The self-explosive is selected from the group consisting of a solid having a nitro- or nitramine- group; said nitrosolution being formed with a first liquid with which said self-explosive forms a single phase at said elevated temperature; said dispersion being formed with a second liquid which provides the fuel, provided said fuel second liquid and said solvent first liquid are immiscible, that is, do not form a single phase; and, said emulsion is formed with an inert surfactant or emulsifier.

It is a specific object of this invention to provide a shaped mass of high energy explosive comprising discrete crystals of a nitramine such as HMX and/or RDX, optionally in combination with a nitroaromatic compound such as but not limited to trinitrotoluene, the crystals being in crystal-to-crystal contact, and in which mass is trapped separate phases of the solvent (first liquid), surfactant or emulsifier, and fuel (second liquid), as microdomains, whereby the mass may be detonated.

DETAILED DESCRIPTION OF PREFERRED EMBODIMENTS

In general, the self-explosive, or mixture of self-explosives, selected to form the hot nitrosolution is chosen by the essential criterion that the self-explosive(s) be soluble, preferably highly soluble in a nitrosolvent (first liquid), at an elevated but acceptably safe dissolution temperature, so as to form a concentrated single phase nitrosolution. The upper dissolution temperature is limited by the boiling point of the nitrosolvent, or the melting point of the self-explosive, whichever is lower, and the degree of safety desired. The dissolution temperature used will preferably be in the range from about 80° C. to about 150° C. By "highly soluble" I refer to a solubility of at least an equal part by weight of self-explosive and nitrosolvent, and preferably from about 5 to about 50 times as much self-explosive as nitrosolvent, at a dissolution temperature above the recrystallization temperature of the self-explosive, the dissolution temperature preferably being in the range from about 1° C. to about 30° C. above the recrystallization temperature.

A dispersion of surfactant or emulsifier in a second liquid (fuel), hereafter referred to as "surfactant-in-fuel", provides the other necessary component of the emulsion from which the explosive is derived. It is essential that the nitrosolution of self-explosive and the fuel be immiscible to form the emulsion, and that it be formed at an elevated temperature which is above the recrystallization temperature of the self-explosive from the nitrosolution. Further, upon cooling to a temperature below the recrystallization temperature, the self-explosive will supercool thus preventing the rapid growth of crystals in the mass. This supercooling effect permits enough time to shape the emulsion while allowing it to cool, without developing deleterious internal fissures and voids.

The range in which the supercooling is observed will depend upon the components of the system but will typically be at least 2° C., generally from about 5° C. to about 40° C. below the recrystallization temperature of the self-explosive. It is the supercooling effect that facilitates the growth of discrete crystals, and provides the enhanced contact between the components of the explosive. By "discrete crystals" I refer to microcrystals ranging from submicron size to about 200 microns in diameter such as are formed when an emulsion recrystallizes after being supercooled.

Self-explosives particularly useful in this invention are high energy materials such as dinitrotoluene (DNT), trinitrotoluene (TNT), 1-nitroguanidine, cyclo-1,3,5 -trimethylene-2,4,6-trinitramine (RDX), cyclo-1,3,5,7 -tetramethylene-2,4,6,8-tetranitramine (HMX), pentaerythritoltetranitrate (PETN), trinitro-2,4,6-phenylmethylnitramine (tetryl) and diamino-trinitrobenzene (DATNB), nitroglycerine (NG), nitrocellulose (NC) and nitrostarch (NS).

The self-explosive is the major component of the explosive composition which may be present in an amount in the range from above 50% to about 97% by weight of the explosive composition, and preferably from about 70% to about 85% by wt of the composition.

Nitrosolvents useful to prepare the nitrosolution include benzene, toluene, xylene, lower alkyl ($C_1$–$C_6$) substituted derivatives thereof, and halogenated and nitrated derivatives thereof, particularly bromo- and chloroxylenes, and nitroxylenes respectively, nitroparaffins and halogenated nitroparaffins which are liquid at the emulsion processing temperature, lower alkyl ketones such as acetone and carbon disulfide.

The nitrosolvent is a minor component of the explosive composition which may be present in an amount in the range from about 5% to about 15% by weight of the explosive composition, and preferably from about 10% to about 15% by wt of the composition.

Fuels useful to prepare the surfactant-in-fuel dispersion are preferably non-self-explosive, such as hydrocarbons, halogenated hydrocarbons but may also include glycols, nitroparaffins, and the like, as long as the fuel is substantially insoluble in the nitrosolvent. Typically the fuel is selected from the group consisting of mineral oils, fuel oils, lubricating oils, liquid paraffins, microcrystalline waxes, paraffin waxes, and even the foregoing solvents for the self-explosive, provided the nitrosolution is immiscible in the fuel, that is, results in at least two phases. Preferred fuels are long chain ($C_7$–$C_{26}$) nitroparaffins, halogenated long chain paraffins such as chlorinated paraffins, lower alkylene ($C_2$–$C_6$) and dialkylene glycols such as hexylene glycol and diethylene glycol, glycol ethers, nitroglycols, and aliphatic and naphthenic mineral oils.

The fuel may be present in an amount in the range from about 2 to about 25% by weight of the explosive composition, and preferably from about 3% to about 12% by wt of the composition.

The surfactant or emulsifier suitable for forming the emulsion of nitrosolution in the surfactant-in-fuel D-phase is not narrowly critical provided it is inert and adapted to emulsify the particular nitrosolution and surfactant-in-fuel mixture at a temperature above the recrystallization temperature. For example, an emulsifier which reacts with the self-explosive is readily identified in the particular instance of a TNT solution, by the development of color. Reactions of other surfactants or emulsifiers may result in generation of heat, evolution of gases, or in some case, formation of precipitates. Inert surfactants or emulsifiers are exemplified by ethoxylated long chain linear or aromatic alcohols. Other suitable surfactants or emulsifying agents include alkyl benzene sulfonates, phosphate esters such as oleyl acid phosphate, sorbitan esters, PEG (polyethylene glycol) mono- and diesters, and the like.

The concentration of the surfactant or emulsifying agent is generally in the range from about 1% to about 10%, and preferably from about 3% to about 7% by wt of the composition in an essentially anhydrous emulsion, which in turn consists essentially of first and second liquid phases which are immiscible organic liquids. In many instances the amount of emulsifier used is equal in wt to the amount of fuel (say, ethylene glycol) of the emulsifier is preferably chosen so as to function as a fuel in addition to functioning as an emulsifier or surfactant.

In a preferred embodiment, the explosive composition is formed by gradually dissolving self-explosive in hot nitrosolvent until a supersaturated nitrosolution is formed. Typically, the nitrosolution will contain from 10 to 20 times as much self-explosive as there is solvent. The self-explosive may be molten and the temperature of the solution maintained well above the recrystallization temperature.

Separately, a dispersion is formed, by dispersing the surfactant or emulsifier in the fuel (say, ethylene glycol) and it is heated to a temperature equivalent to that at which the nitrosolution is maintained. The nitrosolution is then gradually added to the dispersion while vigorously stirring, to form an emulsion. The emulsion is maintained above the recrystallization temperature of the self-explosive until a homogeneous emulsion is obtained.

After the emulsion is formed, sensitizers, phlegmatizing agents, ballistic modifiers and the like may be added as particulate non-reactive additives which are essentially insoluble in the nitrosolvent or fuel, and do not interfere with the progressive inversion of the emulsion.

The composition has a thick creamy consistency which consists essentially of microdomains (microdroplets) of nitrosolution as the D-phase, in a C-phase of surfactant-fuel. The composition thus formed may cool to a temperature below the recrystallization temperature of the oxidizer used, without recrystallizing. This "supercooling" of the emulsion allows the composition to be poured or injected into a cavity at a lower temperature than the melting point of the self-explosive. Upon still further cooling and aging, the supercooling effect cannot be maintained, the emulsion becomes unstable and will invert.

Destabilization and subsequent inversion results in formation of discrete crystals of the self-explosive, gradually forming a mass conforming to the shape of the cavity in which it is contained. Microdomains of surfactant and/or emulsifier, and fuel phases separate and are interstially (between crystals) trapped, as are domains of surfactant-in-fuel. The proportions of each phase will vary depending upon the particular choice of components of the system. Whether these proportions are unacceptably high may be readily determined by routine trial and error such as one skilled in the art would expect to undertake under these circumstances.

It is only because the relative amount of solvent is so small, that the presence of the nitrosolution phase in the shaped mass does not substantially adversely affect the properties of the explosive. Destabilization also results in transformation of the C-phase into a D-phase, whether of nitrosolvent or of solvent substantially free of self-explosive. The shaped mass is thus a heterogeneous mixture of nitrosolvent, fuel, surfactant and/or emulsifier in a crystalline mass of self-explosive.

The invention is illustrated by, but not limited to the following example in which all parts and percentages are expressed on a weight basis unless otherwise specified.

EXAMPLE 2028 g of TNT are dissolved in 100 g of hot (about 80° C.) benzene with stirring in a round-bottomed flask to form a substantially anhydrous nitrosolution. In another flask, 105 g of a polymeric surfactant are thoroughly dispersed in 2.10 g of ethylene glycol to form a dispersion (fuel phase) which is heated to about the same temperature as the nitrosolution, namely 80° C. The hot nitrosolution is slowly dripped into the hot dispersion with vigorous agitation so as to form a polyphase (two or more phases) mixture (crude emulsion) consisting of droplets of nitrosolution dispersed in the surfactant-in-fuel dispersion.

When all the nitrosolution is added, the crude emulsion is a thick fluid containing 83% TNT, 4.1% benzene, 4.3% surfactant and 8.6% ethylene glycol (all by weight) The crude emulsion is then refined by high shear mixing until a desirable viscosity is achieved. At this point the high shear mixing is discontinued and the refined emulsion allowed to cool slightly to about 65° C. before transferring it to a molding cavity. Upon further cooling to ambient temperature (about 20° C.) a mass of contiguous crystals (solid phase) is formed, conforming to the shape of the cavity, with minor amounts of liquid phases interstitially distributed therein.

I claim:

1. An explosive composition derived from a non-aqueous unstable emulsion comprising (i) a solution of a self-explosive in a first liquid and, (ii) a dispersion of a surfactant or emulsifier in a second liquid which is non-reactive with said first liquid and essentially insoluble therein;

said emulsion being formed by adding said solution to said dispersion at a temperature above the recrystallization temperature of said self-explosive from said first liquid so as to form droplets of said solution;

said self-explosive being selected from the group consisting of nitro-containing and nitramine containing organic compounds present in a major proportion by weight of said emulsion in which said droplets of said solution form the discontinuous phase and said dispersion forms the continuous phase; and, said surfactant or emulsifier is non-reactive with said self-explosive which remains in solution as the discontinuous phase at a temperature below the recrystallization temperature of said self-explosive, whereby, upon aging and cooling, said emulsion is destabilized, so as to form a mass of contiguous discrete crystals of said self-explosive, in which mass plural phases are trapped, said phases including said first and second liquids, surfactant or emulsifier, and mixtures thereof.

2. The explosive composition of claim 1 wherein said self-explosive is a nitro- or nitramine-containing organic compound selected from the group consisting of dinitrotoluene (DNT), trinitrotoluene (TNT), 1-nitroguanidine, cyclo-1,3,5-trimethylene-2,4,6-trinitramine (RDX), cyclo-1,3,5,7-tetramethylene-2,4,6,8-tetranitramine (HMX), pentaerythritoltetranitrate (PETN), trinitro-2,4,6-phenyl-methylnitramine (tetryl), diamino-trinitrobenzene (DATNB), nitroglycerine (NG), nitrocellulose (NC) and nitrostarch (NS).

3. The explosive of claim 2 wherein said first liquid is selected from the group consisting of benzene, toluene, xylene, ($C_1$–$C_6$) lower alkyl and substituted derivatives thereof, halogenated and nitrated derivatives thereof, including nitroxylenes, nitroparaffins and halogenated nitroparaffins which are liquid at the emulsion forming temperature, lower alkyl ketones, and carbon disulfide.

4. The explosive composition of claim 3 wherein said second liquid is a non-self-explosive selected from the group consisting of hydrocarbons, halogenated hydrocarbons, liquid paraffins, halogenated long chain paraffins, glycols, aliphatic and naphthenic mineral oils, fuel oils, lubricating oils, microcrystalline waxes, paraffin waxes, ($C_3$–$C_{26}$) nitroparaffins, chlorinated paraffins, lower alkylene ($C_2$–$C_6$) and dialkylene glycols such as hexylene glycol and diethylene glycol, glycol ethers, nitroglycols, provided said solution is immiscible in said second liquid so as to form at least two phases.

5. A shaped mass of discrete self-explosive crystals in crystal-to-crystal contact, in which mass is trapped multiple phases of (i) a first liquid in which said self-explosive is soluble at a temperature below said first liquid's boiling point, or, the melting point of the self-explosive, whichever is lower, (ii) a solution of said self-explosive in said first liquid, (iii) a second liquid non-reactive with said first liquid and essentially insoluble therein, (iv) surfactant or emulsifier, and (v) mixtures of said surfactant or emulsifier in said first and second liquids.

6. The shaped mass of claim 5 wherein said self-explosive is a nitro- or nitramine-containing organic compound selected from the group consisting of dinitrotoluene (DNT), trinitrotoluene (TNT), 1-nitroguanidine, cyclo-1,3,5-trimethylene-2,4,6-trinitramine (RDX), cyclo-1,3,5,7-tetramethylene-2,4,6,8-tetranitramine (HMX), pentaerythritoltetranitrate (PETN), trinitro-2,4,6-phenylmethylnitramine (tetryl) and diaminotrinitrobenzene (DATNB), nitroglycerine (NG), nitrocellulose (NC) and nitrostarch (NS).

7. The shaped mass of claim 6 wherein said first liquid is selected from the group consisting of benzene, toluene, xylene, ($C_1$–$C_6$) lower alkyl and substituted derivatives thereof, halogenated and nitrated derivatives thereof, including nitroxylenes, nitroparaffins and halogenated nitroparaffins which are liquid at the emulsion forming temperature, lower alkyl ketones, and carbon disulfide.

8. The shaped mass of claim 7 wherein said second liquid is a non-self-explosive selected from the group consisting of hydrocarbons, halogenated hydrocarbons, liquid paraffins, halogenated long chain paraffin, glycols, aliphatic and naphthenic mineral oils, fuel oils, lubricating oils, microcrystalline waxes, paraffin waxes, ($C_3$–$C_{26}$) nitroparaffins, chlorinated paraffins, lower alkylene ($C_2$–$C_6$) and dialkylene glycols such as hexylene glycol and diethylene glycol, glycol ethers, nitroglycols, provided the nitrosolution is immiscible in said second liquid, so as to form at least two phases.

9. The shaped mass of claim 8 wherein said self-explosive is present in an amount in the range from above 50% to about 97% by weight of said shaped mass.

10. A process for formulating an explosive, comprising, (a) dissolving an organic nitro- or nitramine group containing self-explosive in a first liquid at a temperature above its recrystallization temperature in said first liquid to form a saturated nitrosolution, (b) dispersing a surfactant or emulsifier, which is non-reactive with said self-explosive, in a second liquid non-reactive with said first liquid and essentially insoluble therein, to form a dispersion of surfactant or emulsifier in said second liquid, (c) forming an emulsion by mixing said nitrosolution and said dispersion at a temperature above the recrystallization temperature of said self-explosive, so as to form a continuous phase of surfactant or emulsifier in said second liquid, and a discontinuous phase of nitrosolution droplets homogeneously distributed in said emulsion, whereby said first and second liquids, and said surfactant or emulsifier co-act to provide an emulsion which upon aging and cooling to a temperature sufficiently below the recrystallization temperature, produces a mass of discrete crystals of said self-explosive.

11. The process of claim 10 wherein said first liquid is present in an amount in the range from about 5% to about 15% by weight of said emulsion.

12. The process of claim 11 wherein said second liquid is present in an amount in the range from about 2 to about 25% by weight of said emulsion.

* * * * *